US010759197B2

(12) United States Patent
Yang et al.

(10) Patent No.: US 10,759,197 B2
(45) Date of Patent: Sep. 1, 2020

(54) DIGITAL PRINTING DEVICE

(71) Applicant: SHENZHEN HANWAY INDUSTRIAL DIGITAL EQUIPMENT CO., LTD., Shenzhen, Guangdong (CN)

(72) Inventors: Fuwei Yang, Guangdong (CN); Yifa Zhao, Guangdong (CN); Jizhou Li, Guangdong (CN); Qin Yang, Guangdong (CN); Jianqiang Zhang, Guangdong (CN); Ting Chen, Guangdong (CN); Hong Tian, Guangdong (CN)

(73) Assignee: SHENZHEN HANWAY INDUSTRIAL DIGITAL EQUIPMENT CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 16/305,961

(22) PCT Filed: May 22, 2017

(86) PCT No.: PCT/CN2017/085330
§ 371 (c)(1),
(2) Date: Nov. 30, 2018

(87) PCT Pub. No.: WO2018/045776
PCT Pub. Date: Mar. 15, 2018

(65) Prior Publication Data

US 2019/0193428 A1 Jun. 27, 2019

(30) Foreign Application Priority Data

Sep. 6, 2016 (CN) ..... 2016 1 0809511

(51) Int. Cl.
*B41J 11/00* (2006.01)
*B65H 5/22* (2006.01)
(Continued)

(52) U.S. Cl.
CPC ..... *B41J 11/0085* (2013.01); *B41J 2/16541* (2013.01); *B41J 3/407* (2013.01);
(Continued)

(58) Field of Classification Search
CPC .... B41J 11/0085; B41J 3/407; B41J 2/16541; B41J 29/17; B41J 13/08; B41J 11/007;
(Continued)

(56) References Cited

U.S. PATENT DOCUMENTS 3,955,661 A * 5/1976 Popper ..... F16H 13/08 192/150
2008/0283092 A1* 11/2008 Nagai ..... B41J 2/16538 134/6
2013/0176362 A1* 7/2013 Inoue ..... B41J 2/16535 347/33

FOREIGN PATENT DOCUMENTS

CN 105751696 A * 7/2016 ..... B41J 2/01
JP 10120213 A * 5/1998 ..... B65H 3/12

* cited by examiner

*Primary Examiner* — Yaovi M Ameh
(74) *Attorney, Agent, or Firm* — Donald L Ranft; Collen

(57) ABSTRACT

A digital printing device, comprising a suction transport means (1). The suction transport means (1) comprises a transport belt (11) used for transporting a sheet material. At least one first suction box (14), which is used for sucking the sheet material on the transport belt (11) by means of negative pressure during transport, is provided in the space defined by the transport belt (11). Multiple first suction holes in communication with the first suction box (14) are provided on the transport belt (11). At least one side of the first suction box (14) is provided with a movable door (15) which moves
(Continued)

in a direction perpendicular to the transport direction to make the first suction box (14) fit the sheet material to maintain a negative pressure state. Using the transport belt (11) during printing, the digital printing device avoids the problem of poor registration accuracy, and improves the printing effect.

8 Claims, 10 Drawing Sheets

(51) Int. Cl.

| | |
|---|---|
| ***B41J 13/08*** | (2006.01) |
| ***B41J 29/17*** | (2006.01) |
| ***B41J 2/165*** | (2006.01) |
| ***B41J 3/407*** | (2006.01) |
| *B41J 29/38* | (2006.01) |

(52) U.S. Cl.
CPC ..... *B41J 11/007* (2013.01); *B41J 13/08* (2013.01); *B41J 29/17* (2013.01); *B65H 5/22* (2013.01); *B65H 5/222* (2013.01); *B41J 2/16535* (2013.01); *B41J 29/38* (2013.01)

(58) Field of Classification Search
CPC ..... B41J 2/16535; B41J 29/38; B65H 5/22; B65H 5/222
See application file for complete search history.

DIGITAL PRINTING DEVICE

TECHNICAL FIELD

The present invention relates to the field of printing technology, and more particularly to a digital printing device.

BACKGROUND

On Traditional printers (sheet printers), there are generally two methods in transporting sheets to be printed, that is, a roller-to-roller paper transporting method and a roller suction transporting. If the sheet is transported by a roll-to-roller paper transporting method, requirements for the sheets will be strict. It is necessary to ensure that a leading end of a sheet has entered the second group of rollers when the rear end of the sheet leaves the first group of rollers, so as to ensure that the sheet goes forward normally. This may cause a minimum limit on the length of the sheet in a feeding direction. Moreover, a larger gap between the two rollers will cause that the pulling force is insufficient to send out the sheet, and a smaller gap between the two rollers will cause a larger pressure acting on the sheet, thereby the sheet may be crushed and the strength of the sheet will be affected. If the sheet is transported by the roller suction transporting method, the accuracy of transporting will be poor. Usually, the sheet will be printed in more than two colors, so the registration color accuracy between the two rollers will be relatively poor. In addition, in the suction and transportation process of the prior art, although an air door manually opened and closed is provided on a negative pressure suction box, the air door can only roughly adapt to the width of the sheet while being opened and closed. There are still leakages of air at some suction holes on both sides of the sheet, which causes a poor effect of negative pressure suction.

SUMMARY

The object of the present invention is to provide a digital printing device, which solves the problems in the prior art that the transporting accuracy of sheet to be transported by the negative pressure suction is poor, the requirements for the sheet are strict, and the negative pressure suction effect is poor as the openable/closable door on the negative pressure suction box cannot be precisely adjusted to has same width as the sheet.

The technical solution adopted by the present invention to solve the technical problems is a digital printing device, comprising a suction transport device, the suction transport device comprises a transport belt for transporting a sheet, at least one first suction box, which is configured to suck the sheet on the transport belt by negative pressure during transport, is provided in the space defined by the transport belt, multiple first suction holes in communication with the first suction box are provided on the transport belt, at least one side of the first suction box is provided with a movable door which moves in a direction perpendicular to a transporting direction to make the first suction box maintain a negative pressure state in cooperation with the sheet.

In the digital printing device of the present invention, the movable door is provided with first nuts, which are sleeved on first screw rods and move along with rotation of the first screw rods, and the first screw rods are driven by a first driver.

In the digital printing device of the present invention, the first driver drives the first screw rods to rotate through a transmission mechanism which includes a transmission shaft driven by the first driver to rotate, connecting rods connected in one-to-one correspondence with each of the first screw rods, and a plurality of first bevel gears and second bevel gears engaged with each other, each of the second bevel gears is connected to each of the connecting rods (102) in a one-to-one correspondence, and each of the first bevel gears is connected to the transmission shaft, the transmission shaft and the connecting rods are interacted with each other by the first bevel gears and the second bevel gears.

In the digital printing device of the present invention, a feeding device is disposed at a transport starting end of the suction transport device, the feeding device includes a suction panel and a plurality of feeding wheels, the suction panel is provided with second suction holes, the feeding wheels are disposed at positions corresponding to the second suction holes, and above the second suction hole of an area on at least one side of the suction panel, a windshield cover for covering the area, which is movable to adjust a covering thereof, is mounted.

In the digital printing device of the present invention, the windshield cover includes a fixed end portion, a sliding end portion and a telescopic portion, the fixed end portion is fixed on one side of the suction panel, the telescopic portion is connected between the fixed end portion and the sliding end portion, the sliding end portion moves in a direction perpendicular to a feeding direction and drives the telescopic portion to extend and contract, and sliding end portion causes the telescopic portion to cover the area on one side of the suction panel during movement.

In the digital printing device of the present invention, a dust removing device is disposed above a transport starting end of the suction transport device, the dust removing device includes a first dust removing portion for removing floating dust on a surface of the sheet, a blowing portion for loosening dust adhered on the surface of the sheet, and a second dust removing portion for removing dust adhered on the surface of the sheet and loosened by the blowing portion.

In the digital printing device of the present invention, the first dust removing portion, the blowing portion, and the second dust removing portion are sequentially disposed along the transporting direction of the sheet; the first dust removing portion includes a first dust removing brush, and a fixed member for fixing the first dust removing brush; the second dust removing portion includes an air pumping pipeline, and an air pumping tube is connected to a bottom end of the air pumping pipeline, the bottom end of the air pumping tube is provided with an air pumping opening and a second dust removing brush is disposed around the air pumping opening; the blowing portion includes a blowing pipeline, and a blowing tube is connected to a bottom end of the blowing pipeline, the bottom end of the blowing tube is provided with a blowing opening and the blowing opening is blown toward a side where the second dust removing brush is located; the fixed member for the first dust removing portion is mounted on a side of the blowing pipeline, the second dust removing portion is mounted on a side of the blowing portion in opposition to the first dust removing portion.

In the digital printing device of the present invention, at least one jet printing unit is provided above the transport belt, and each of the jet printing units is provided with a nozzle maintenance device comprising a moisturizing assembly; the moisturizing assembly includes a movable body that can be moved between a first position and a second position, the movable body is provided with a maintenance chamber for accommodating nozzles that keep the jet printing unit wet; scrapers for scraping ink from the nozzles in one-to-one correspondence with each nozzle of the jet printing unit, are provided in the maintenance chamber; the nozzles of the jet printing unit are provided above the first position.

In the digital printing device of the present invention, a cleaning assembly for cleaning the scrapers is provided above the second position, the cleaning assembly includes a fixed body; nozzles for spraying cleaning liquid in one-to-one correspondence with each of the scrapers, are provided on a side of the fixed body facing the second position, a liquid groove for containing the cleaning liquid, which is connected with each nozzle, is provided on a side of the fixed body in opposition to the nozzles; at an edge of the maintenance chamber of the moisturizing assembly, a seal member is provided.

In the digital printing device of the present invention, one end of the scraper is formed with a curved blade; the nozzle includes a main body, on which a containing groove for accommodating the blade is provided, and at least one spray hole is provided at a bottom of the containing groove.

Embodying the digital printing device of the present invention has the following beneficial effects: by transporting sheets using the transport belt during printing, the digital printing device of the present invention avoids the problem of poor registration accuracy, and improves the printing effect. Moreover, by providing the movable door on the first suction box, the present invention makes the width of the first suction box to accurately fit the width of the sheet, so that sheets of different specifications can be can be adapted to transport in corresponding negative pressure suction areas, and there will be no air leakage and the negative pressure suction effect is good.

DRAWINGS

DETAILED DESCRIPTION

Figure 1:
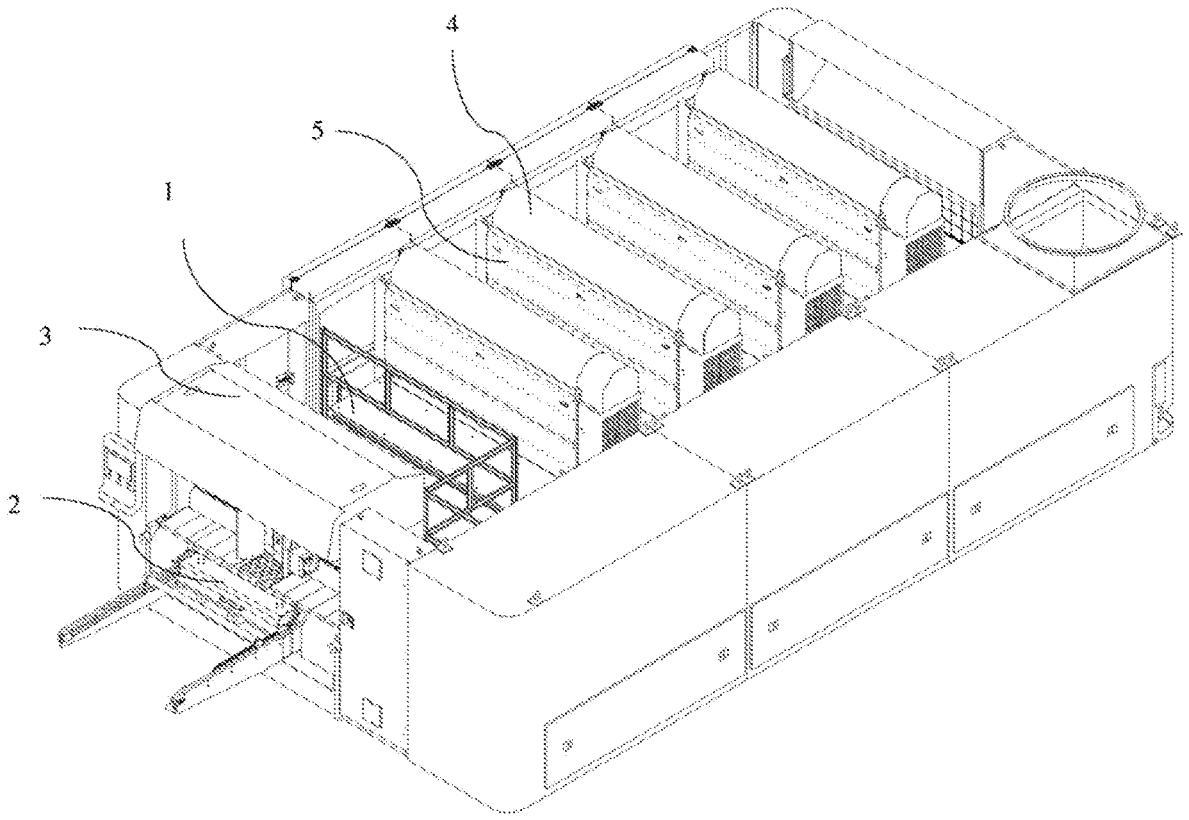
FIG. 1 is a schematic structural view of the digital printing device in the present invention.

The structure and functional principle of a digital printing device of the present invention will be further described below in combination with the accompanying drawings and embodiments:

In the description of the present invention, it is necessary to understand that orientations or positional relationships indicated by the terms such as "center", "longitudinal", "widthwise", "up", "down", "front", "rear", "left", "right", "vertical", "horizontal", "top", "bottom", "inside", "outside", "clockwise", and "counterclockwise" are based on orientations or positional relationships shown in the drawings, and are intended only to facilitate to descript the present invention and simplify the description, rather than to indicate or imply that the device or element referred to must have a specific orientation or be constructed and operated in a specific orientation, therefore, they cannot be understood as a restriction on this invention.

Figure 2:
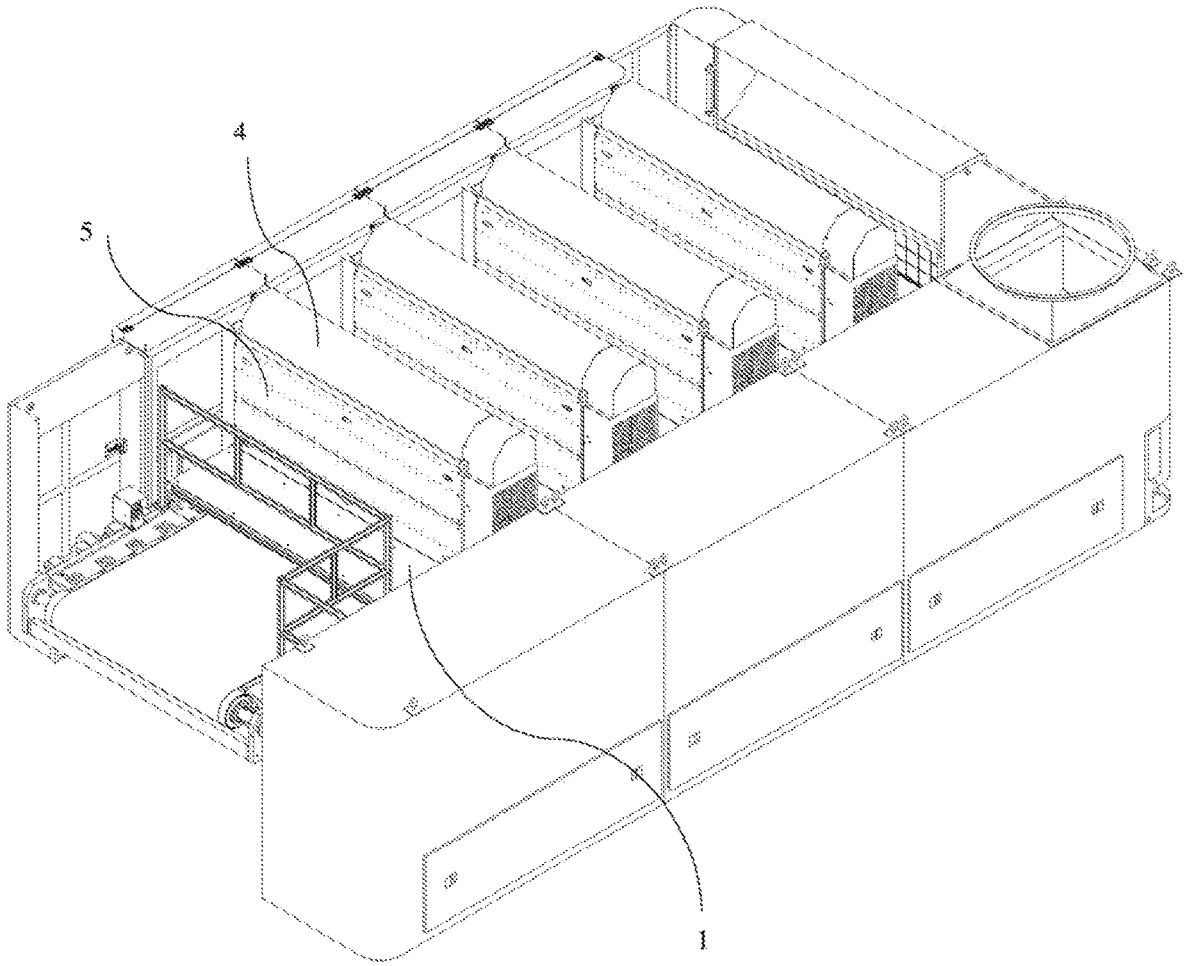
FIG. 2 is a schematic structural view of a part of the structure of the digital printing device in the present invention.

As shown in FIG. 1-2, the digital printing device includes a suction transport device 1, a feeding device 2, a dust removing device 3, a jet printing unit 4, and a nozzle maintenance device 5 disposed on the jet printing unit 4. The feeding device 2 is installed at a transport starting end of the suction transport device 1. The dust removing device 3 is provided above the transport starting end of the suction transport device 1. At least one jet printing unit is provided above the transport belt. The nozzle maintenance device is configured in one-to-one correspondence with each printing unit. The jet printing unit can be multiple and be arranged along a transporting direction. On the other hand, there may be one jet printing unit.

Figure 3:
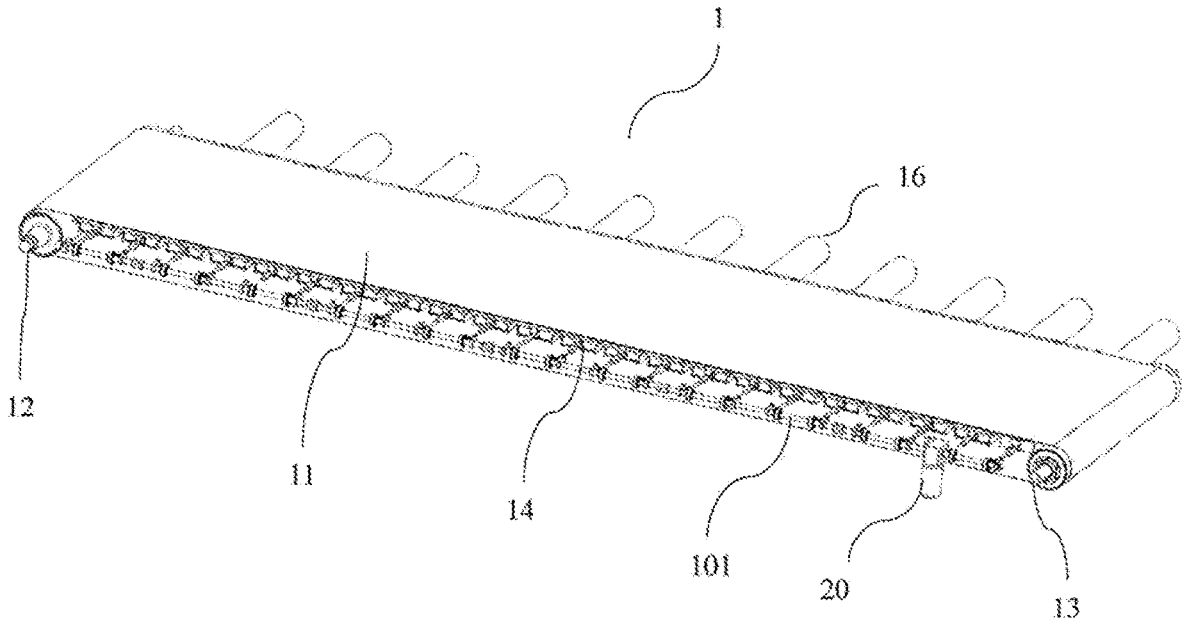
FIG. 3 is a schematic structural view of a suction transport device in the present invention.

As shown in FIG. 3, the suction transport device 1 includes a transport belt 11 for transporting sheets, a main driving roller 12 for driving the transport belt 11 to move, a follow driving roller 13 rotating along with the movement of the transport belt 11, and a second driver (not shown in the drawings) driving the main driving roller 12 to rotate. The second driver can be a motor or an electric motor, and can be directly connected with the main driving roller 12, or can be connected with the main drive roller 12 through a transmission.

Figure 4:
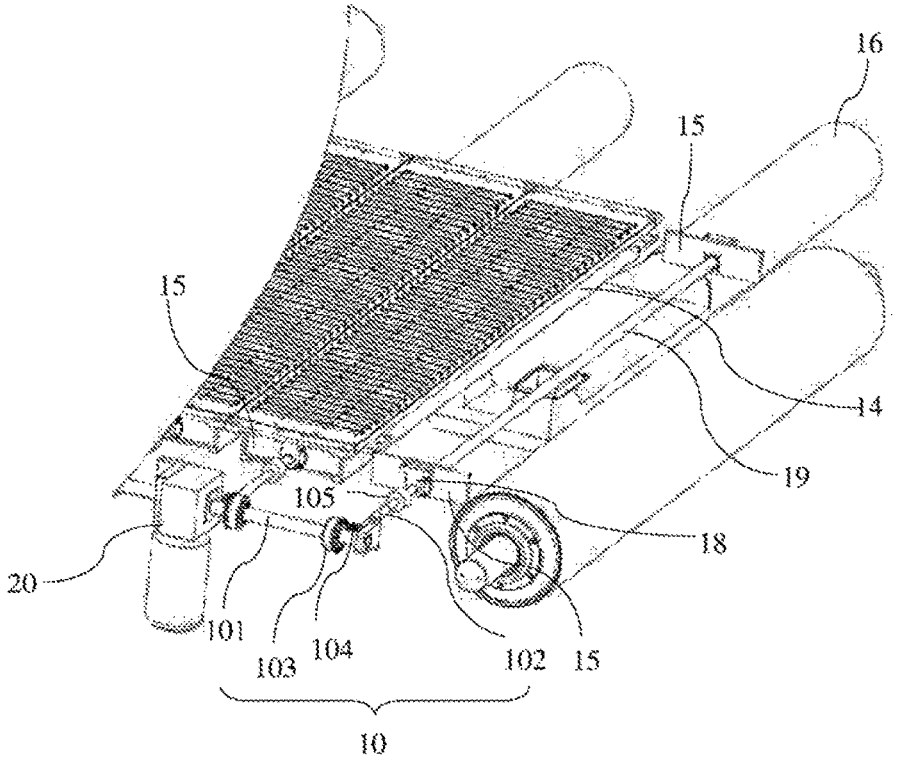
FIG. 4 is a schematic partially-enlarging structural view of the suction transport device in the present invention.

As shown in FIGS. 3-4, at least one negative pressure first suction box 14, which is configured to suck the sheet on the transport belt 11 by negative pressure during transport, is provided in the space defined by the transport belt 11. Multiple first suction holes (not shown in the drawings) in communication with the negative pressure first suction box 14 are provided on the transport belt 11. At least one side of the negative pressure first suction box 14 is provided with a movable door 15 which moves in a direction perpendicular to the transporting direction to make the negative pressure first suction box 14 maintain a negative pressure state in cooperation with the sheet. The negative pressure first suction box 14 is installed with a first vacuum pumping device (not shown in the drawings), which forms a negative pressure by suction. The negative pressure first suction box 14 may be directly connected to the first vacuuming pumping device, or may be connected to the first vacuuming pumping device through an air suction pipe 16. The top end of the negative pressure first suction box 14 is provided with vents 141 which are communicated with the first suction holes.

Figure 5:
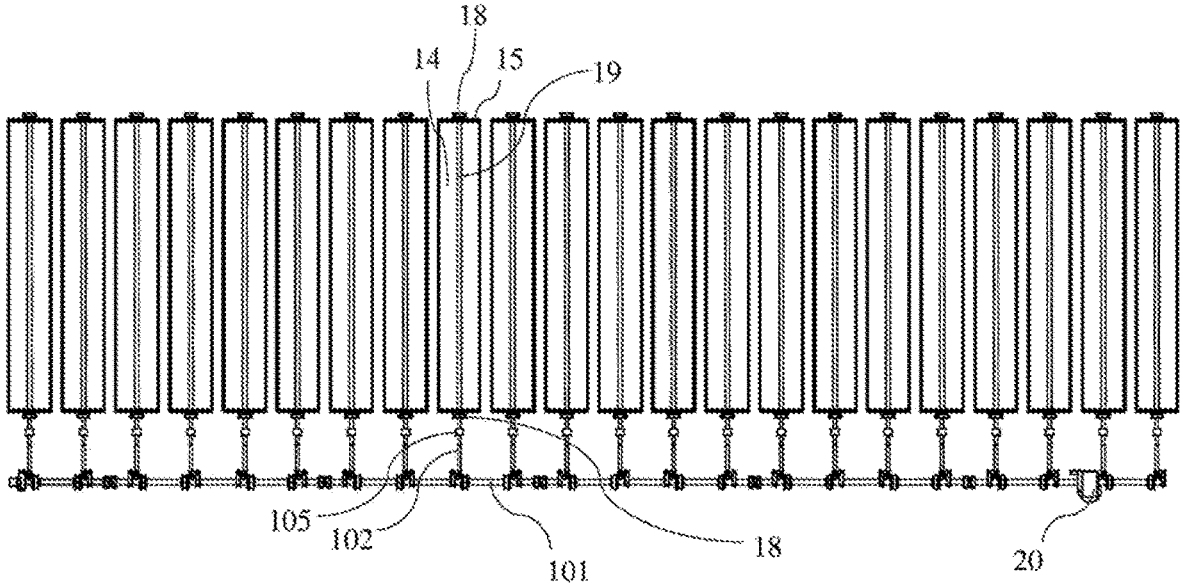
FIG. 5 is a schematic top view of the suction transport device in the present invention.

In this embodiment, as shown in FIGS. 4 and 5, the number of the negative pressure first suction box 14 is plural and the negative pressure first suction boxes are arranged sequentially along the transporting direction. The sidewalls of each of the negative pressure first suction boxes 14 located on both sides of the transport belt 11 are provided with movable doors 15, each of which is provided with a first nut 18. The first nuts 18 are sleeved on first screw rods 19 and moves along with rotation of the first screw rods 19. The first screw rods 19 are driven by the first driver 20. The first driver 20 can be an electric motor or a motor. The first nuts 18 on two opposite movable doors 15 of same negative pressure first suction box 14 are sleeved on same first screw rod 19.

Two ends of the first screw rod 19 are respectively formed with a positive thread segment and a reverse thread segment, and two adjacent first screw rods are configured as follows: an A end of the first one of the first screw rods is formed as the positive thread segment, and an A end of the adjacent second one of the first screw rods is formed as the reverse thread segment; a B end of the first one of the first screw rods is formed as the reverse thread segment, and a B end of the adjacent second one of the first screw rods is formed as the positive thread segment. When the first screw rod 19 is rotated, the first nuts 18 at both ends of the first screw rod 19 will move relative to each other or move away from each other at the same time, which drives the two opposite movable doors 15 on the same negative pressure first box 14 to move relative to each other or to move away from each other at the same time. The first screw rods 19 are disposed perpendicular to the transporting direction of the transport belt 11. The first nuts 18 drive the movable doors 15 to move along a lengthwise direction of the first screw rods 19. Each of the negative pressure first suction boxes 14 is configured in one-to-one correspondence with each of the first screw rods 19.

The first driver 20 drives each first screw rod 19 to rotate through the transmission mechanism 10. The transmission mechanism 10 includes a transmission shaft 101 driven by the first driver 20 to rotate, connecting rods 102 connected in one-to-one correspondence with each of the first screw rods 19, and a plurality of first bevel gears 103 and second bevel gears 104 engaged with each other. Each of the second bevel gears 104 is connected to each of the connecting rods 102 in a one-to-one correspondence, and each of the first bevel gears 103 is connected to the transmission shaft 101. The transmission shaft 101 and the connecting rods 102 are interacted with each other by the first bevel gears 103 and the second bevel gears 104. The connecting rod 102 is connected with the first screw rod 19 through a coupling 105. The transmission shaft 101 is disposed to extend along the transporting direction of the transport belt 11. The first bevel gear 103 and the second bevel gear 104 are engaged vertically with each other.

When the width of the sheet is smaller than the width of the transport belt 11, the first driver 20 is started to drive the transmission shaft 101 to rotate, and the transmission shaft 101 drives each connecting rod 102 to rotate through the first bevel gears 103 and the second bevel gears 104, thereby driving the first screw rod 19 to rotate. Then, the first nuts 18 at both ends of the first screw rod 19 drives the movable door 15 to move, so that the distance between the movable doors 15 is substantially the same as the width of the sheet, and the space formed by the top, bottom and two movable doors 15 of the negative pressure first suction box 14 is located directly below the sheet. When vacuuming begins, the space can be in an approximate vacuum state, so that the sheet is maintained in a negative pressure suction state.

In another embodiment, the number of the negative pressure first suction box 14 is one, and it is integrally placed in the space defined by the transport belt 11. The number of the first screw rod 19 is also one, and both ends are formed with a positive thread segment and a reverse thread segment, respectively.

In another embodiment, a sidewall of each of the negative pressure first suction boxes 14 located on one side of the transport belt 11 is set as the movable door 15, and a sidewall on the other side is fixedly connected to the negative pressure first suction box 14. One end of the first screw rod 19 near the movable door 15 is formed with a threaded segment. When the number of the first screw rods 19 is plural, two adjacent first screw rods 19 are configured as follows: an A end of the first one of the first screw rods is formed as the positive thread segment, and an A end of the adjacent second one of the first screw rods is formed as the reverse thread segment. When the width of the sheet is smaller than the width of the transport belt 11, the sheet is placed near an edge of one side of the transport belt 11. The position of the movable door 15 is designed to be located on the other side of the transport belt 11. When the first driver 20 is started to drive the transmission shaft 101 to rotate, the transmission shaft 101 drives each of the connecting rods 102 to rotate by the first bevel gears 103 and the second bevel gears 104, thereby driving the first screw rod 19 to rotate, and the first nut 18 on the first screw rod 19 drives the movable door 15 to move, so that the distance between the movable door 15 and an opposite sidewall of the negative pressure first suction box 14 is substantially the same as the width of the sheet, and the space formed by the top, bottom and a movable door 15 of the negative pressure first suction box 14 is directly below the sheet. When vacuuming begins, the space can be in an approximate vacuum state, so that the sheet is maintained in the negative pressure suction state.

In another embodiment, the first screw rod 19 can be directly driven by the first driver 20 to rotate, without the transmission mechanism 10. When the number of the first screw rods 19 is plural, each of the first screw rods 19 is provided with a first driver 20.

By transporting sheets using the transport belt during printing, the problem of poor registration accuracy can be avoided, and the printing effect can be improved. At the same time, the first suction box is provided with a movable door that can be moved to realize a stepless adjustment, so that the width of the first suction box is accurately matched with the width of the sheet, thereby adapting to transport of the sheets of the different specifications in corresponding negative pressure suction areas. There will be no air leakage and the negative pressure suction effect is good.

Figure 6:
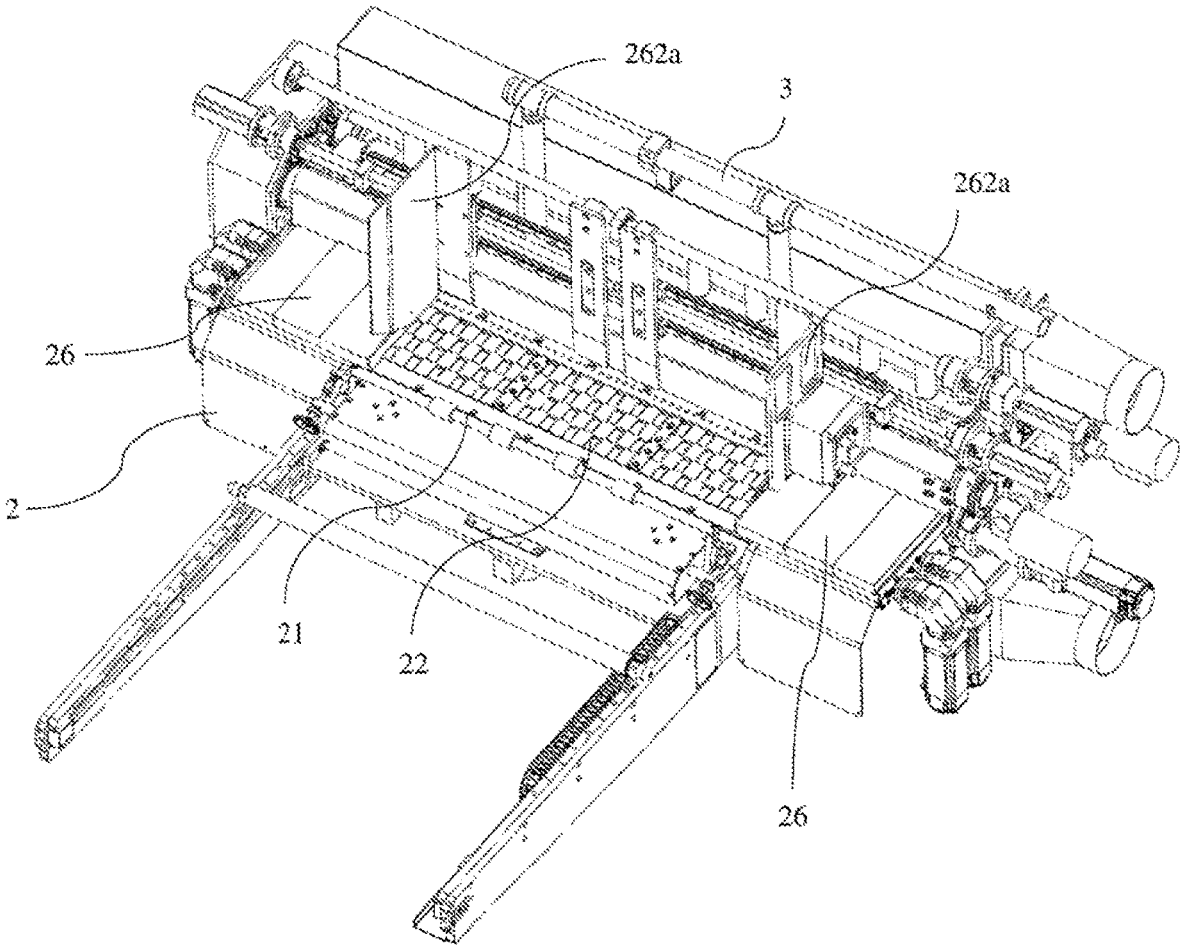
FIG. 6 is a schematic structural view of a combined structure of a feeding device and a dust removing device in the present invention.
Figure 7:
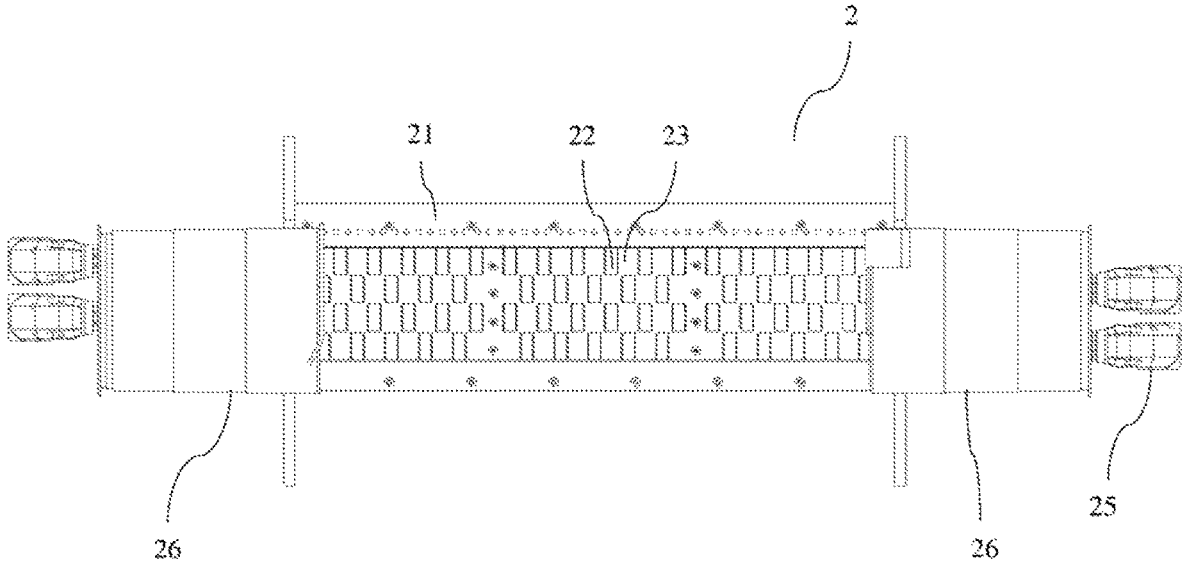
FIG. 7 is a schematic top view of the feeding device in the present invention.
Figure 8:
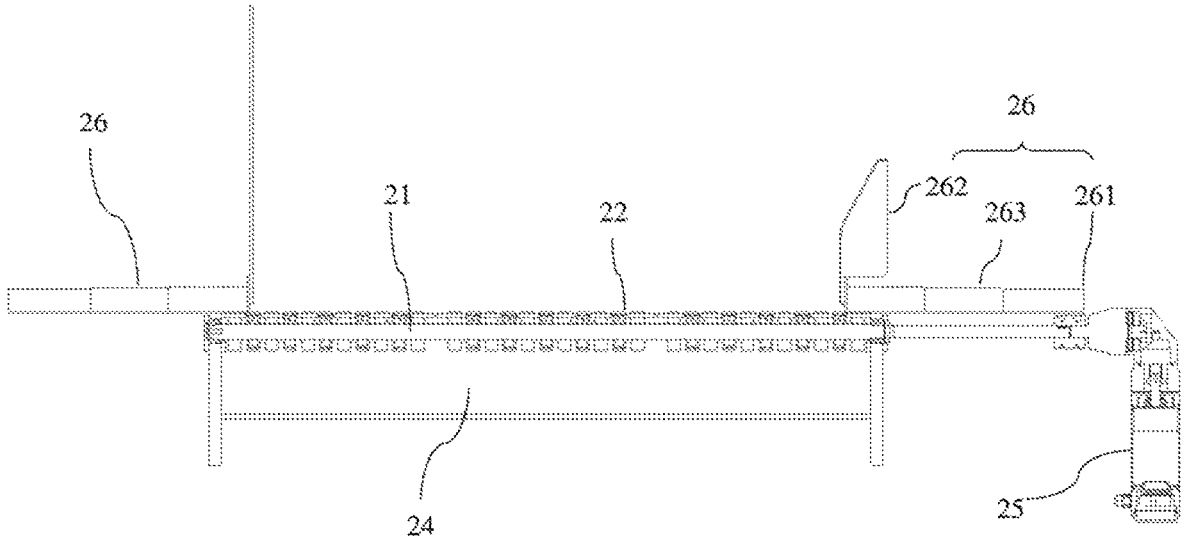
FIG. 8 is a schematic side view of the feeding device in the present invention.

As shown in FIGS. 6-8, the feeding device 2 includes a suction panel 21 and a plurality of feeding wheels 22. The suction panel 21 is provided with second suction holes 23 that suck the sheet on the suction panel 21 by negative pressure. The feeding wheels 22 are disposed at positions corresponding to the second suction holes 23. Specifically, there is a gap between the feeding wheel 22 and a corresponding hole wall of the second suction hole 23. A second suction box 24, which is assembled with the suction panel 21 together, is provided below the suction panel 21, for negative pressure suction, and the second suction box 24 is connected with a second vacuum pumping device (not shown in the drawings), so that a negative pressure can be formed in the second suction box 24. Preferably, a plurality of feeding wheels 22 are arranged in a plurality of rows along the feeding direction on the suction panel 21. More preferably, two adjacent rows of the feeding wheels 22 are staggered. In other embodiments, the feeding wheels 22 can also be distributed freely. Each row of the feeding wheels 22 is driven by roller shafts (not shown in the drawings) to rotate. The feeding wheels 22 are sleeved on the roller shafts which are driven by a third driver 25 to rotate. The third driver 25 can be a motor or a servo motor.

Above the second suction holes 23 of an area on at least one side of the suction panel 21, a windshield cover 26, which covers the second suction holes 23 in the area on the one side so as to maintain the sheet in a negative pressure suction state, is mounted. The number of the windshield cover 26 may be one. The sheet covers the second suction holes 23 in the area on the one side of the suction panel 21. The windshield cover 26 is provided on the other side of the suction panel 21 and covers the second suction holes 23 that are not covered in the area of the one side; the number of the windshield cover 26 also may be two, and the two windshield covers 26 are respectively provided on both sides of the suction panel 21. The sheet is placed in a middle position in the suction panel 21, and the two windshield covers 26 respectively cover the second suction holes 23 that are not covered by the sheet on both sides of the suction panel 21.

In this embodiment, the windshield cover 26 includes a fixed end portion 261, a sliding end portion 262 and a telescopic portion 263. The fixed end portion 261 is fixed on one side of the suction panel 21. The telescopic portion 263 is connected between the fixed end portion 261 and the sliding end portion 262. The sliding end portion 262 moves in a direction perpendicular to the feeding direction and drives the telescopic portion 263 to extend and contract. The sliding end portion 262 causes the telescopic portion 263 to cover the second suction holes 23 in the area on one side of the suction panel 21 during movement. An erected baffle 262*a* or a handle or the like is provided on the sliding end portion 262. The telescopic portion 263 is folded and telescopic. The sliding end portion 262 is manually moved.

In another embodiment, the telescopic portion 263 includes a plurality of plates that are connected to each other in a staggered and overlapped manner, and each of two adjacent plates can be moved relative to each other, and the sliding end portion 262 is also moved manually.

In another embodiment, the sliding end portion 262 is provided with a second nut which is sleeved on a second screw rod and is moved along with rotation of the second screw rod. The second screw rod is driven by a fourth driver or manually. The second screw rod extends in a direction perpendicular to the transporting direction of the sheet, that is, the lengthwise direction thereof is the same as the direction perpendicular to the transporting direction of the sheet. The fourth driver can be a motor or an electric motor. In addition, when the number of the windshield covers 26 is two and the two windshield covers are respectively provided on both sides of the suction panel 21, the thread directions of the second nuts on the sliding end portions 262 of the two windshield covers 26 are opposite, and both of the second nuts are sleeved on the same second screw rod, so that the sliding end portions 262 are moved toward each other or away from each other at the same time. In other embodiments, it can be that both ends of the same second screw rod are formed respectively as the positive thread segment and the reverse thread segment, so that the sliding end portions 262 are moved toward each other or away from each other at the same time.

In another embodiment, the windshield cover 26 is a door that can be moved in a direction perpendicular to the feed direction, that is, a common sliding door-like door body, and the windshield cover 26 covers the second suction holes in the area on one side of the suction panel 21 during the movement.

By providing a stretchable windshield cover on at least one side of the suction panel of the feeding device, it is possible to accurately adapt to the width of the sheet to be printed, and the stretchable windshield cover can completely cover the suction holes that are not covered by the sheet, so that a better negative pressure suction effect can be maintained.

Figure 9:
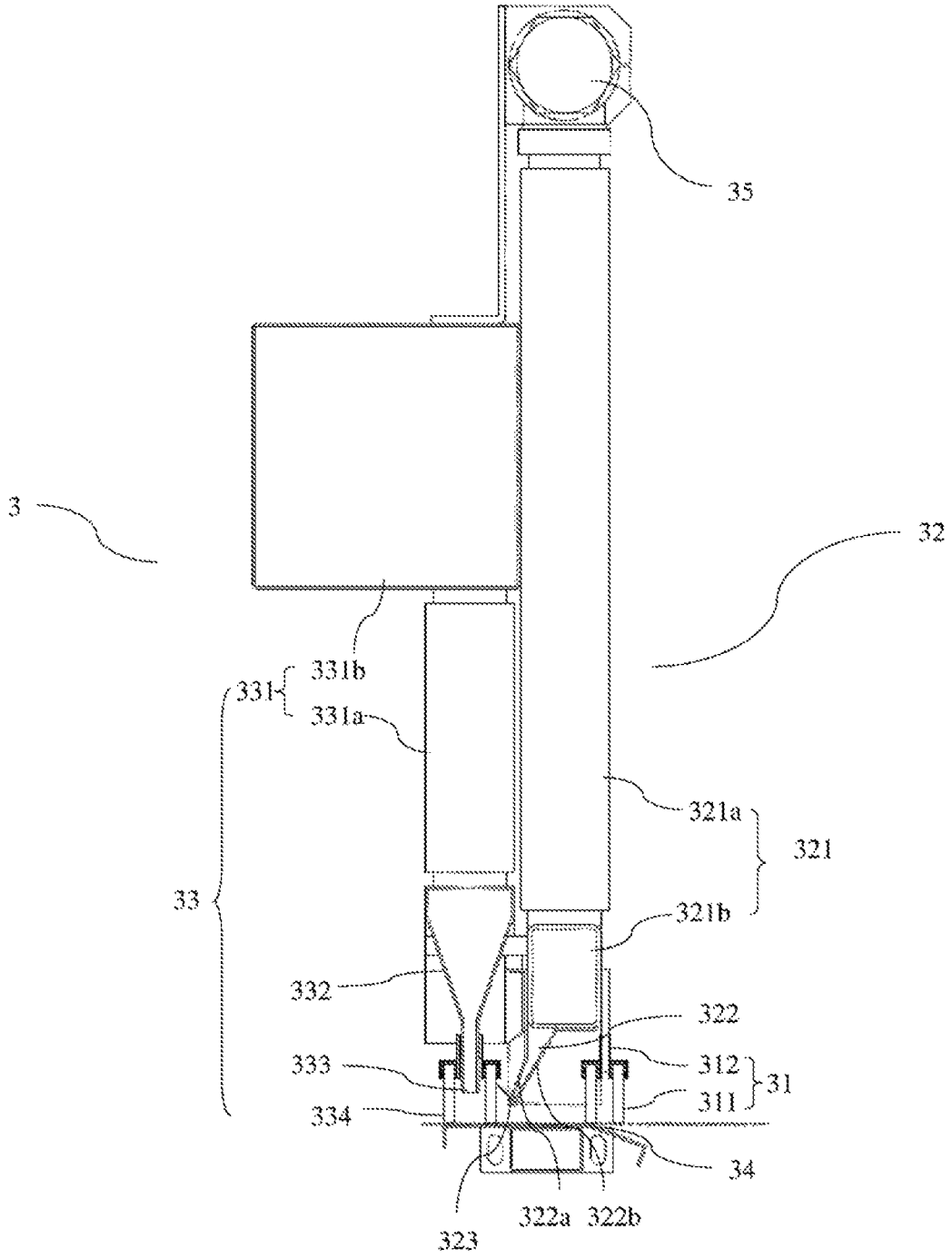
FIG. 9 is a schematic front view of the dust removing device in the present invention.
Figure 10:
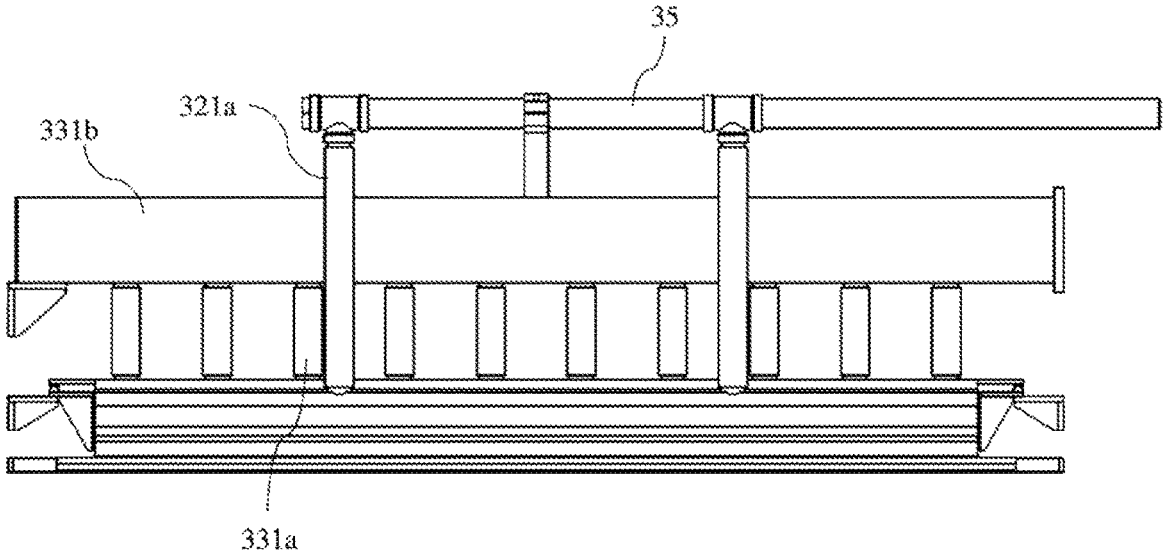
FIG. 10 is a schematic side view of the dust removing device in the present invention.

As shown in FIGS. 6, 9, and 10, the dust removing device 3 includes a first dust removing portion 31 for removing floating dust on a surface of the sheet, a blowing portion 32 for loosening dust adhered on the surface of the sheet, and a second dust removing portion 33 for removing dust adhered on the surface of the sheet and loosened by the blowing portion 32. In this embodiment, the first dust removing portion 31, the blowing portion 32, and the second dust removing portion 33 are sequentially disposed along the transporting direction of the sheet. In other embodiments, the blowing portion 32, the second dust removing portion 33, and the first dust removing portion 31 can be sequentially disposed along the transporting direction.

The first dust removing portion 31 includes a first dust removing brush 311, and a fixed member 312 for fixing the first dust removing brush 311. The second dust removing portion 33 includes an air pumping pipeline 331. An air pumping tube 332 is connected to a bottom end of the air pumping pipeline 331. The bottom end of the air pumping tube 332 is provided with an air pumping opening 333 and a second dust removing brush 334 is disposed around the air pumping opening 333. The blowing portion 32 includes a blowing pipeline 321. A blowing tube 322 is connected to a bottom end of the blowing pipeline 321. The bottom end of the blowing tube 322 is provided with a blowing opening 323 and the blowing opening 323 is blown toward a side where the second dust removing brush 334 is located. The fixed member 312 for the first dust removing portion 31 is mounted on a side of the bottom end of the blowing pipeline 321. The second dust removing portion 33 is mounted on a side of the blowing portion 32 in opposition to the first dust removing portion 31.

A support portion 34 for supporting the sheet is provided under the first dust removing portion 31, the second dust removing portion 33 and the blowing portion 32, and is located between the suction panel 21 of the feeding device 2 and the transport belt 11 of the suction transport device 1. A tip end of the first dust removing brush 311 and a tip end of the second dust removing brush 314 are maintained at a predetermined distance from the support portion 34. The predetermined distance is equal to or smaller than a thickness of the sheet, which is being transported.

The blowing pipeline 321 includes a blowing pipe 321*a* and a blowing beam 321*b* that are connected with each other. The blowing pipe 321*a* and the blowing beam 321*b* are perpendicular to each other. A top end of the blowing pipe 321*a* is fixed by a fixed portion 35. The blowing beam 321*b* is connected at the lower end of the blowing pipe 321*a*. The blowing pipe 321*a* is connected to a gas generating device (not shown in the drawings) and discharges gas having a certain pressure through the gas generating device. The blowing pipe 321*a* is erected on the blowing beam 321*b*. The lengthwise direction of the blowing beam 321*b* extends along a direction perpendicular to the feeding direction, and one or more blowing pipes 321*a* can be erected on the blowing beam 321*b*. The blowing tube 322 is connected to a lower end on a side of the blowing beam 321*b* near the second dust removing portion 33 and is connected to the blowing beam 321*b*. A side of the blowing beam 321*b* in opposition to the second dust removing portion 33 is connected to the first dust removing brush 311 through the fixed member 312. The first dust removing brush 311 includes two rows of brushes respectively fixed on both sides of the fixed member 312, and the length of the first dust removing brush 311 is substantially the same as the length of the blowing beam 321*b*. In other embodiments, the first dust removing brush 311 may also include only one brush. The fixed member 321 is provided with a plurality of slender slots (not shown in the drawings) and can be fixed by screws passing through the slender slots. Since the slender slots are provided, the fixed member 312 can be moved up and down as needed, so that the distance between the tip end of the first dust removing brush 311 and the support portion 34 can be adjusted to adapt the sheets with different thicknesses.

The blowing tube 322 gradually narrows toward the blowing opening 323 from top to bottom, which facilitates the airflow to be ejected at a large speed, so that an intensity of the airflow that being blown is enhanced. The blowing tube 322 includes an upper air blade 322*a* and a lower air blade 322*b*. The upper air blade 322*a* is provided with a plurality of slender slots (not shown in the drawings) and is fixed by screws passing through the slender slots. As needed, the upper air blade 322*a* can be moved up and down through the slender slots, so that a size of the blowing opening 323 can be adjusted.

The air pumping pipeline 331 of the second dust removing portion 33 includes an air pumping pipe 331*a* and an air pumping beam 331*b* that are connected with each other. A top end of the air pumping beam 331*b* is fixed by the fixed portion 35. A bottom end of the air pumping beam 331*b* is connected with a top end of the air pumping pipe 331*a*. The top end of the air pumping tube 332 is connected with the bottom end of the air pumping pipe 331*a* and is connected with the air pumping pipe 331*a*. The air pumping beam 331*b* and the air pumping pipe 331*a* are perpendicular to each other, that is, the air pumping pipe 331*a* is erected under the air pumping beam 331*b*, and one or more air pumping pipe 331*a* may be erected under the air pumping beam 331*b*. The lengthwise direction of the air pumping beam 331*b* extends along the direction perpendicular to the feeding direction, that is, it is the same as the lengthwise direction of the blowing beam 321*b*. The air pumping tube 332 is generally in a funnel shape. The second dust removing brush 334 includes two brushes respectively provided on both sides of the air pumping opening 333 at the bottom end of the air pumping tube 332. In other embodiments, the second dust removing brush 334 may also include only one brush. The air pumping beam 331*b* is connected to an air pumping device (not shown in the drawings) which may be an air pump or a blower. The length of the second dust removing brush 334 is substantially the same as that of the air pumping tube 332.

In operation, the sheet is transported onto the support portion 34, and the surface to be printed of the sheet firstly contacts with the tip end of the first dust removing brush 311 of the first dust removing portion 31. Since the distance between the tip end of the first dust removing brush 311 and the support portion 34 is equal to or smaller than the thickness of the sheet, the tip end of the first dust removing brush 311 can sweep away dust and paper dust on the surface to be printed; when the sheet continues to move and enter the area where the blowing portion 32 is located, the airflow is ejected from the blowing opening 323, which can loosen the dust adhered on the surface to be printed; when the sheet continues to move into the area where the second dust removing portion 33 is located, the distance between the tip end of the second dust removing brush 334 and the support portion 34 is equal to or smaller than the thickness of the sheet, so that the dust that has been loosened can be swept away by the second dust removing brush 334 and taken away by the air pumping tube 332, the air pumping pipe 331*a* and the air pumping beam 331*b*.

During the movement, the sheet is subjected to dust removals by the first dust removing portion 31 and the second dust removing portion 33, and the surface to be processed of the sheet is subjected to dust removal twice to meet the requirements for high dust removal effect.

Figure 11:
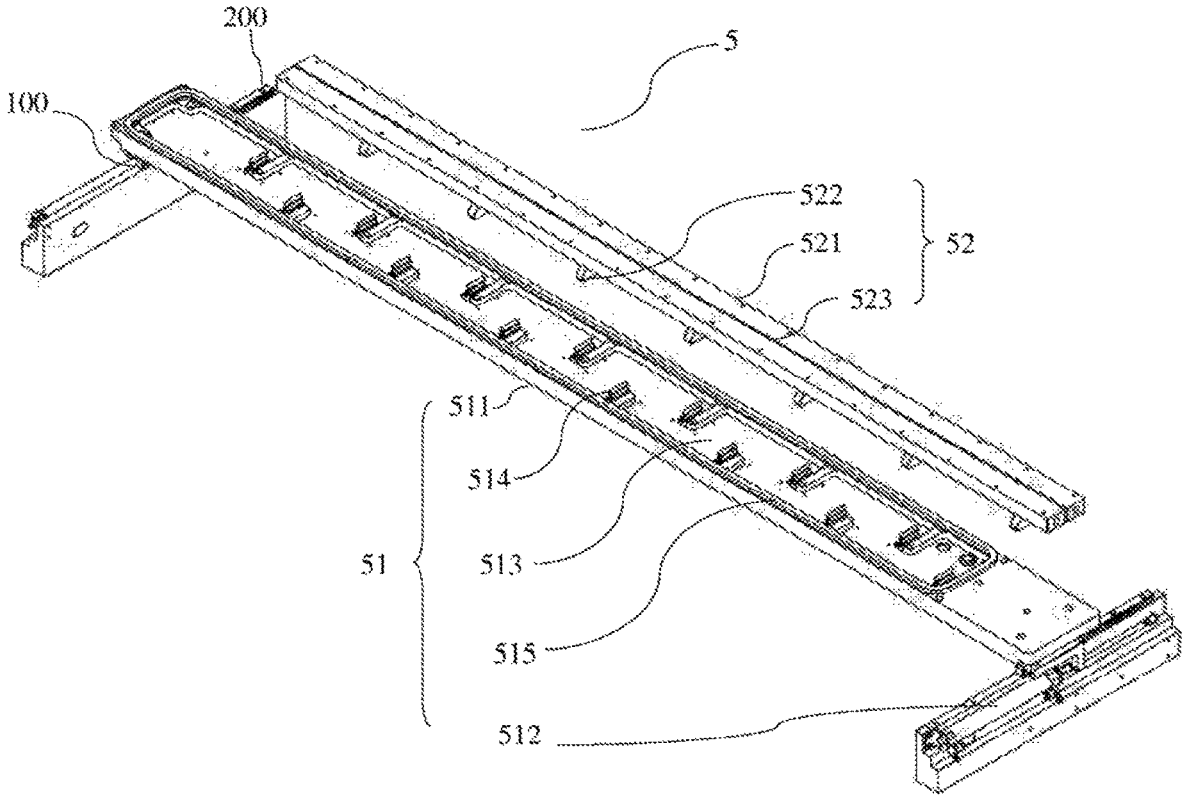
FIG. 11 is a schematic structural view of a nozzle maintenance device in a first state in the present invention.
Figure 12:
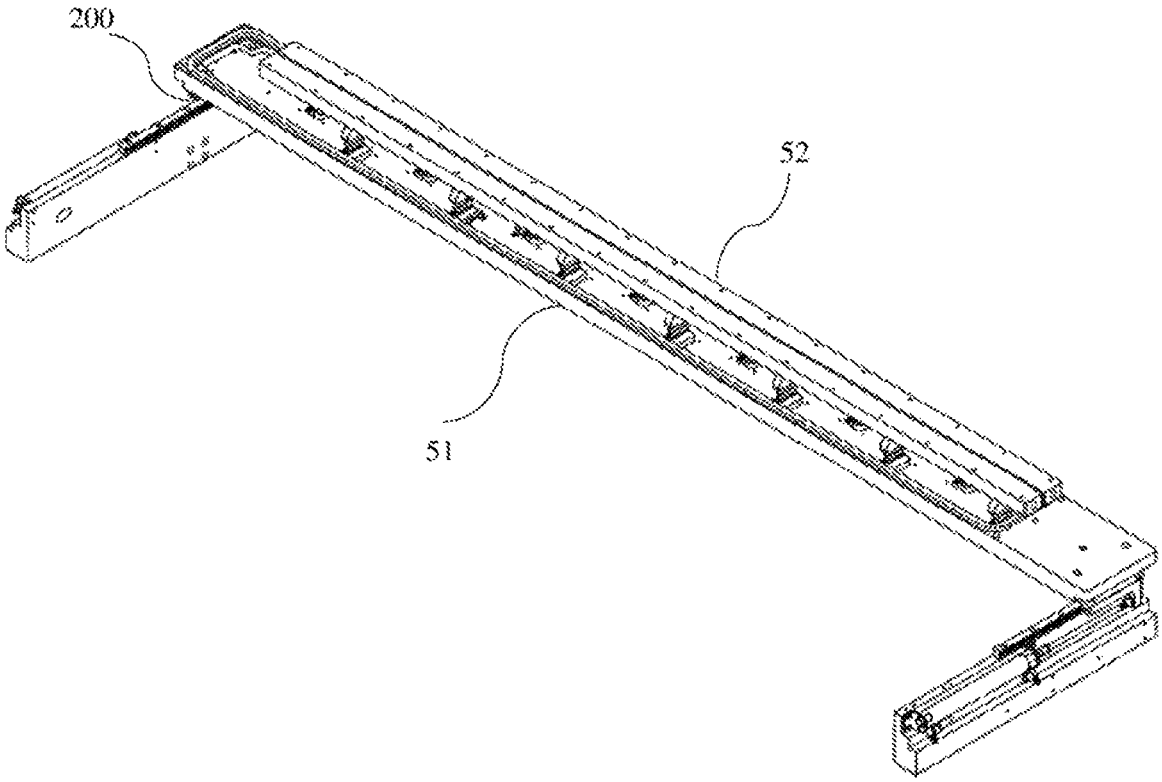
FIG. 12 is a schematic structural view of the nozzle maintenance device in a second state in the present invention.

As shown in FIGS. 11-12, the nozzle maintenance device 5 includes a moisturizing assembly 51 comprising a movable body 511 that can be moved between a first position 100 and a second position 200. Both ends of the movable body 511 are provided with slide rails (not shown in the drawings) and driving members 512. The movable body 511 has sliders (not shown in the drawings) which move along the slide rails. The driving members 512 drive the sliders to move, so that the movable body 511 is driven to move along the slider between the first position 100 and the second position 200. The driving member 512 can be an air cylinder or a hydraulic cylinder, etc. In other embodiments, the movable body 511 can be driven to move by a motor in cooperation with a belt transmission or a nut screw driving device.

The movable body 511 is provided with a maintenance chamber 513 for accommodating nozzles that keep the jet printing unit 4 wet. The maintenance chamber 513 contains moisturizing liquid. Scrapers 514 for scraping ink from the nozzles in one-to-one correspondence with each nozzle of the jet printing unit 4, are provided in the maintenance chamber 513. The nozzles of the jet printing unit 4 are provided above the first position 100. The scraper 514 has an end for scraping ink from the nozzle, which is formed with a blade (not shown in the drawings) slightly curved obliquely upward.

Figure 13:
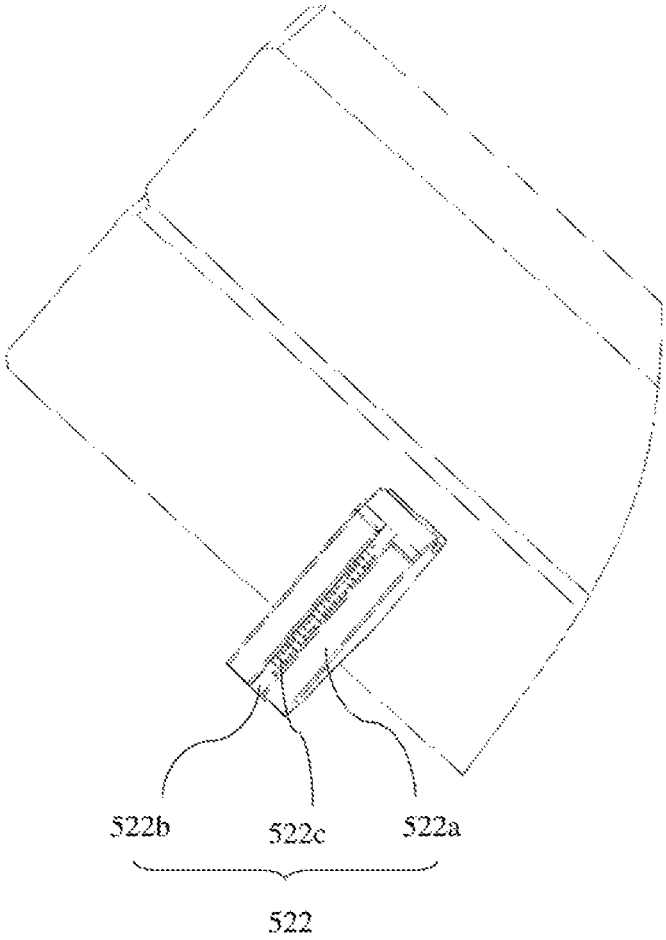
FIG. 13 is a schematic structural view of the nozzles of the nozzle maintenance device in the present invention.

A cleaning assembly 52 for cleaning the scrapers 514 is provided above the second position 200. The cleaning assembly 52 includes a fixed body 521. Nozzles 522 for spraying cleaning liquid in one-to-one correspondence with each of the scrapers 514, are provided on one side of the fixed body 521 facing the second position 200. When the movable body 511 is moved to the second position 200, the nozzles 522 are substantially located directly above the scrapers 514. A liquid groove 523 for containing the cleaning liquid, which is connected with each nozzle 522, is provided on one side of the fixed body 521 in opposition to the nozzles 522. As shown in FIG. 13, each of the nozzles 522 includes a main body 522*a*, on which a containing groove 522*b* for accommodating the blade of the scraper 514 is provided. At least one spray hole 522*c* is provided at the bottom of the containing groove 522*b*. That is, there may be one spray hole 522*c* or a plurality of spray holes 522*c* opened at the bottom of the containing groove 522*b*. In addition, in other embodiments, the containing groove 522*b* is not provided on the main body 522*a* of the nozzles 522, and spray hole (s) 522*c* is (are) directly provided on the main body 522*a*. The cleaning liquid flows from the liquid groove 523 to each of the nozzles 522, and is ejected through the spray hole(s) 522*c* to clean the scrapers 514.

At an edge of the maintenance chamber 513 of the moisturizing assembly 51, a seal member 515 is provided. The seal member 515 can be a rubber strip, or the seal member 515 can be oil, which can realize a seal with an oil seal. This ensures that the maintenance chamber 513 is kept in a sealed state during the moisturizing process of the nozzles of the jet printing unit 4, to thereby prevent the moisturizing liquid in the maintenance chamber 513 from volatilizing.

As shown in FIG. 11, when the nozzles of the jet printing unit 4 are not in operation, the moisturizing assembly 51 enters the first position 100, and the jet printing unit 4 contacts tightly with the seal member 515 to form a sealed state, to thereby prevent the moisturizing liquid in the maintenance chamber 513 from volatilizing. The nozzles make moisturizing maintenance through the moisturizing liquid. A plurality of avoidance slots (not shown in the drawings) for accommodating the scrapers 514 are provided on bottom plates of the nozzles, ensuring that the nozzles does not collide with the scraper 514 when entering into the moisturized state.

As shown in FIG. 12, when the nozzles of the jet printing unit 4 is needed to print, the driving member 512 drives the movable body 511 to move to the second position 200, and the moisturizing assembly 51 enters an automatic cleaning position. At this time, the nozzles 522 are located directly above the scrapers 514, and the cleaning liquid sprayed from the nozzles 522 sprays and cleans the scrapers 514. This cleaning liquid is flowing in the liquid groove 523 to ensure the cleaning effect.

The above nozzle maintenance device can effectively flush the ink on the scrapers off by spraying the cleaning liquid from top to bottom by the cleaning assembly that can move to the top of the scrapers. In addition, the scrapers are fixed in the moisturizing assembly, which is advantageous to simplify the structure, compared with the traditional scrapers and the moisture-retaining assembly, which are independent assemblies.

It should be understood that, modifications or changes may be made in accordance with the above description for the person skilled in the art, but such modifications or changes should be within the scope of the claims appended in the present invention.

The invention claimed is:

1. A digital printing device comprising a suction transport device (1), wherein the suction transport device (1) comprises a transport belt (11) for transporting a sheet, at least one first suction box (14), which is configured to suck the sheet on the transport belt (11) by negative pressure during transport, is provided in the space defined by the transport belt (11), multiple first suction holes in communication with the first suction box (14) are provided on the transport belt (11), at least one side of the first suction box (14) is provided with a movable door (15) which moves in a direction perpendicular to a transporting direction to make the first suction box (14) maintain a negative pressure state in cooperation with the sheet;

wherein the movable door (15) is provided with first nuts (18) which are sleeved on first screw rods (19) and move along with rotation of the first screw rods (19), and the first screw rods (19) are driven by a first driver (20);

wherein the first driver (20) drives the first screw rods (19) to rotate through a transmission mechanism (10) which includes a transmission shaft (101) driven by the first driver (20) to rotate, connecting rods (102) connected in one-to-one correspondence with each of the first screw rods (19), and a plurality of first bevel gears (103) and second bevel gears (104) engaged with each other, each of the second bevel gears (104) is connected to each of the connecting rods (102) in a one-to-one correspondence, and each of the first bevel gears (103) is connected to the transmission shaft (101), the transmission shaft (101) and the connecting rods (102) are interacted with each other by the first bevel gears (103) and the second bevel gears (104).

2. The digital printing device according to claim 1, wherein a feeding device (2) is disposed at a transport starting end of the suction transport device (1), the feeding device (2) includes a suction panel (21) provided with second suction holes (23) and a plurality of feeding wheels (22) disposed at positions corresponding to the second suction holes (23), and above the second suction hole (23) in an area on at least one side of the suction panel (21), a windshield cover (26) for covering the area, which is movable to adjust a covering area thereof, is mounted.

3. The digital printing device according to claim 2, wherein the windshield cover (26) includes a fixed end portion (261) fixed on one side of the suction panel (21), a sliding end portion (262) and a telescopic portion (263) connected between the fixed end portion (261) and the sliding end portion (262), the sliding end portion (262) moves in a direction perpendicular to a feeding direction and drives the telescopic portion (263) to extend and contract, and the sliding end portion (262) causes the telescopic portion (263) to cover the area on one side of the suction panel (21) during movement.

4. The digital printing device according to claim 1, wherein a dust removing device (3) is disposed above a transport starting end of the suction transport device (1), the dust removing device (3) includes a first dust removing portion (31) for removing floating dust on a surface of the sheet, a blowing portion (32) for loosening dust adhered on the surface of the sheet, and a second dust removing portion (33) for removing dust adhered on the surface of the sheet and loosened by the blowing portion (32).

5. The digital printing device according to claim 4, wherein the first dust removing portion (31), the blowing portion (32), and the second dust removing portion (33) are sequentially disposed along the transporting direction of the sheet; the first dust removing portion (31) includes a first dust removing brush (311), and a fixed member (312) for fixing the first dust removing brush (311); the second dust removing portion (33) includes an air pumping pipeline (331), and an air pumping tube (332) is connected to a bottom end of the air pumping pipeline (331), the bottom end of the air pumping tube (332) is provided with an air pumping opening (333) and a second dust removing brush (334) is disposed around the air pumping opening (333); the blowing portion (32) includes a blowing pipeline (321), and a blowing tube (322) is connected to a bottom end of the blowing pipeline (321), the bottom end of the blowing tube (322) is provided with a blowing opening (323) and the blowing opening (323) is blown toward a side where the second dust removing brush (334) is located; the fixed member (312) for the first dust removing portion (31) is mounted on a side of the blowing pipeline (321), the second dust removing portion (33) is mounted on a side of the blowing portion (32) in opposition to the first dust removing portion (31).

6. The digital printing device according to claim 1, wherein at least one jet printing unit (4) is provided above the transport belt (11), and each of the jet printing units (4) is provided with a nozzle maintenance device (5) comprising a moisturizing assembly (51); the moisturizing assembly (51) includes a movable body (511) that can be moved between a first position (100) and a second position (200), the movable body (511) is provided with a maintenance chamber (513) for accommodating nozzles that keep the jet printing unit (4) wet; scrapers (514) for scraping ink from the nozzles in one-to-one correspondence with each nozzle of the jet printing unit (4), are provided in the maintenance chamber (513); the nozzles of the jet printing unit (4) are provided above the first position (100).

7. The digital printing device according to claim 6, wherein a cleaning assembly (52) for cleaning the scrapers (514) is provided above the second position (200), the cleaning assembly (52) includes a fixed body; nozzles (522) for spraying cleaning liquid in one-to-one correspondence with each of the scrapers (514), are provided on a side of the fixed body (521) facing the second position (200); a liquid groove (523) for containing the cleaning liquid, which is connected with each nozzle (522), is provided on a side of the fixed body (521) in opposition to the nozzles (522); at an edge of the maintenance chamber (513) of the moisturizing assembly (51), a seal member (515) is provided.

8. The digital printing device according to claim 7, wherein one end of the scraper (514) is formed with a curved blade; the nozzle (522) includes a main body (522*a*), on which a containing groove (522*b*) for accommodating the blade is provided, and at least one spray hole (522*c*) is provided at a bottom of the containing groove (522*b*).

* * * * *